United States Patent [19]

Dwosh et al.

[11] Patent Number: 4,598,340

[45] Date of Patent: Jul. 1, 1986

[54] PORTABLE BOOK LIGHT

[76] Inventors: Jack Dwosh, 10000 Santa Monica Blvd., Los Angeles, Calif. 90067; Clive Edwards, 2698 Locksley Pl., Los Angeles, Calif. 90039

[21] Appl. No.: 768,622

[22] Filed: Aug. 23, 1985

[51] Int. Cl.[4] ..... A47B 19/00; F21L 7/00

[52] U.S. Cl. ..... 362/98; 362/183; 362/186; 362/188; 362/199; 362/269; 362/285

[58] Field of Search ..... 362/199, 98, 99, 183, 362/186, 187, 188, 269, 285

[56] References Cited

U.S. PATENT DOCUMENTS

| | | | |
|---|---|---|---|
| 2,377,538 | 6/1945 | Cohen | 362/99 |
| 2,561,744 | 7/1951 | Langdon et al. | 362/99 |
| 2,955,194 | 10/1960 | Clyne | 362/99 |
| 3,092,335 | 6/1963 | Wilson | 362/99 |
| 3,823,312 | 7/1974 | Weinstein | 362/99 |
| 4,432,042 | 2/1984 | Zeller | 362/99 |

*Primary Examiner*—E. Rollins Cross
*Attorney, Agent, or Firm*—Thomas I. Rozsa

[57] ABSTRACT

The present invention relates to a portable source of light which can be easily attached to the object to be illuminated, contains a self contained energy source, provides a shielding mechanism by which the light bulb is prevented from coming into contact with other objects, can be folded in order to be easily transported and provides a mechanism by which the source of light can be automatically turned off when the container in which the light source is housed comes in contact with another physical object.

9 Claims, 13 Drawing Figures

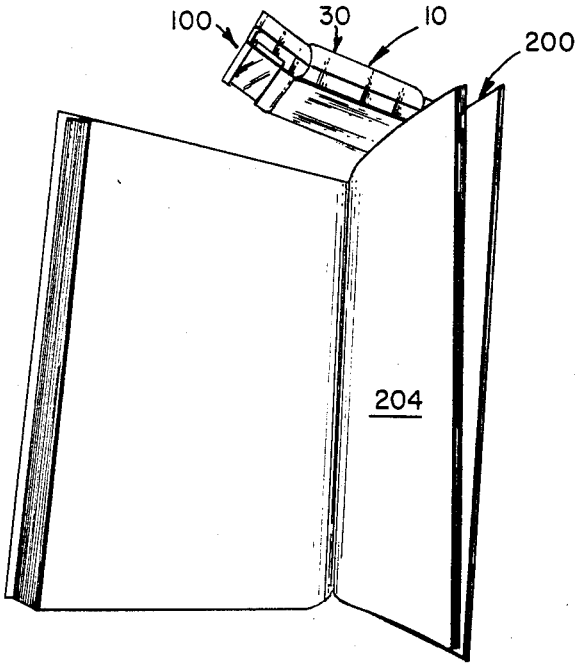
Fig. 1.
Fig. 3.
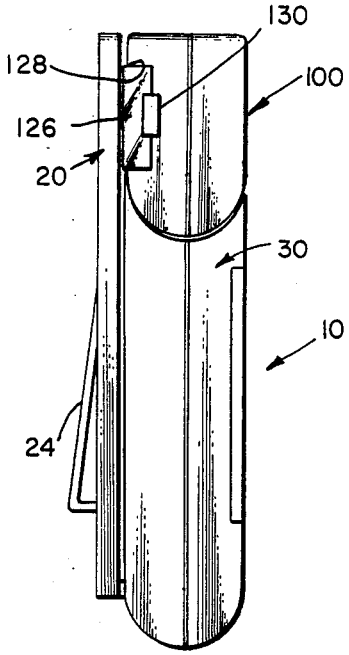
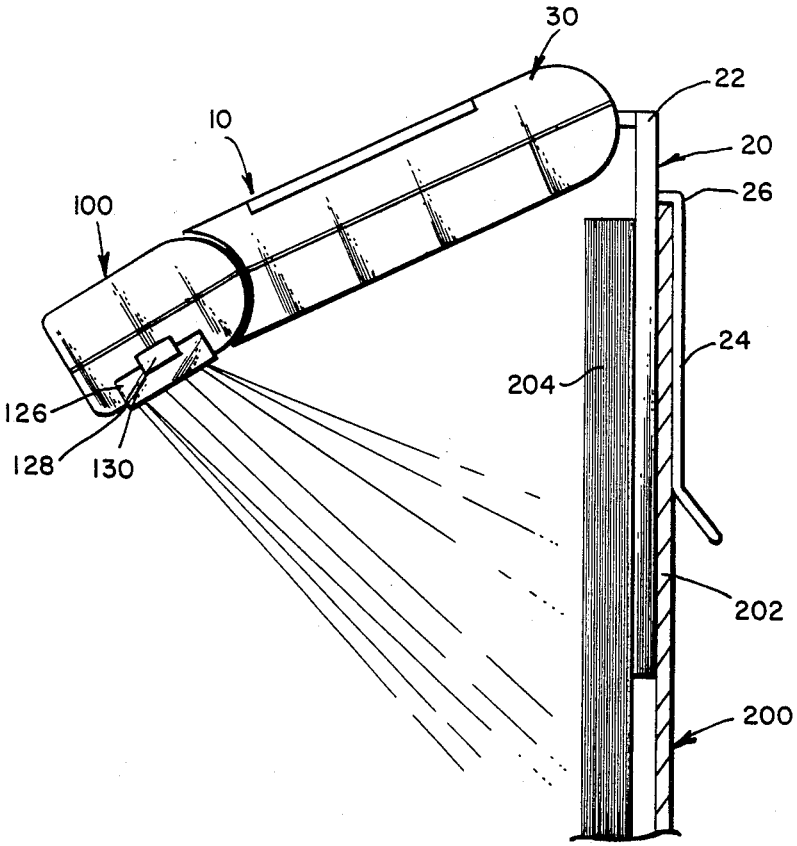
Fig. 2.

Fig. 4.
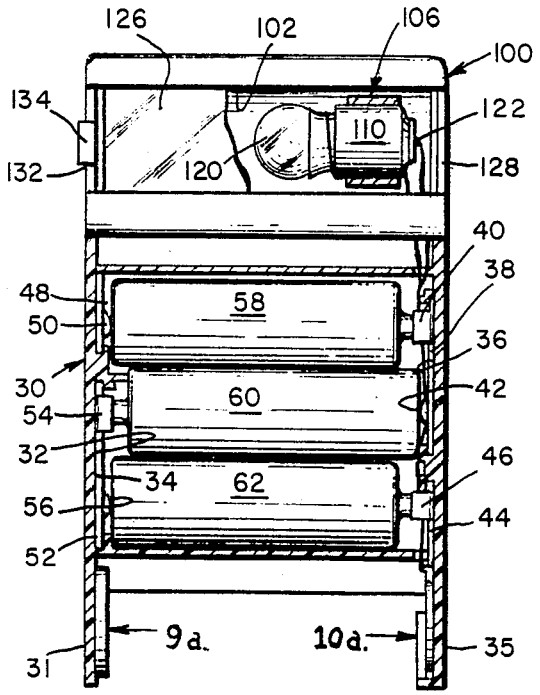
Fig. 5.
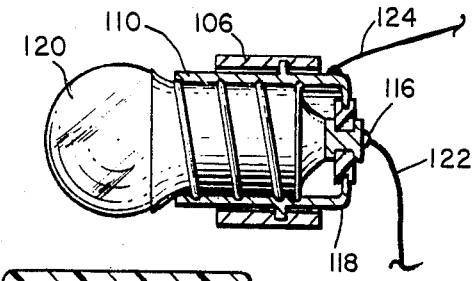
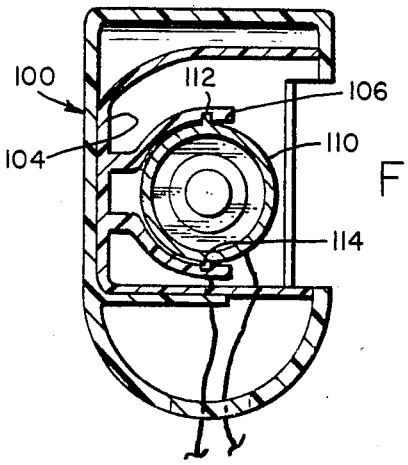
Fig. 6.
Fig. 7.
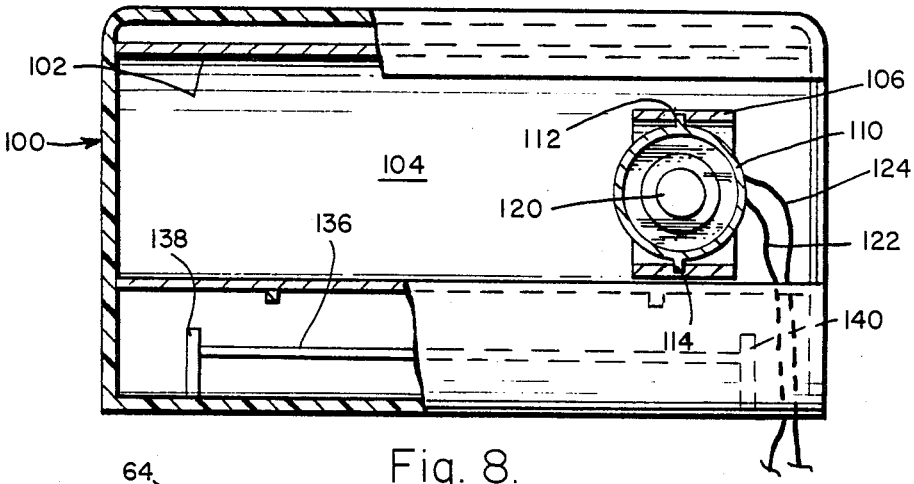
Fig. 8.
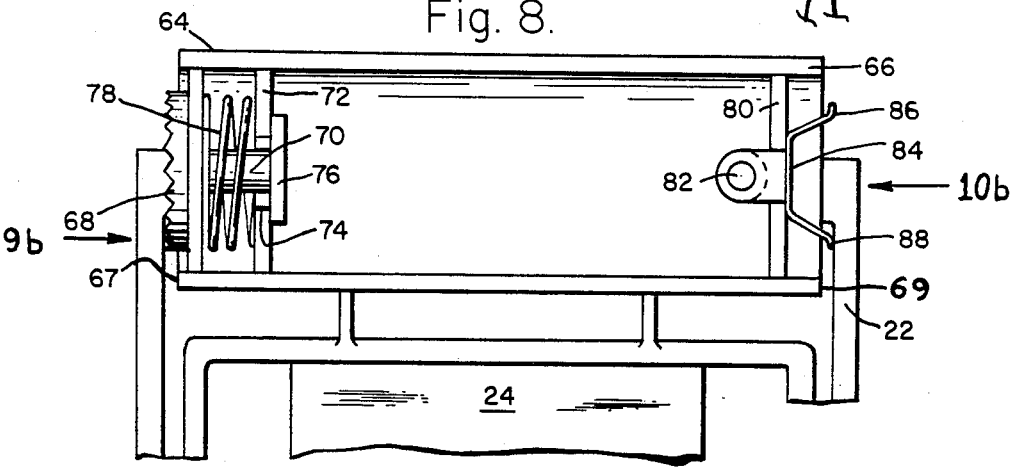

FIG. 9a
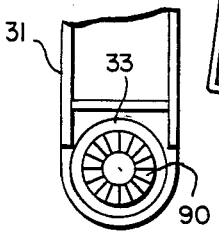
FIG. 9b
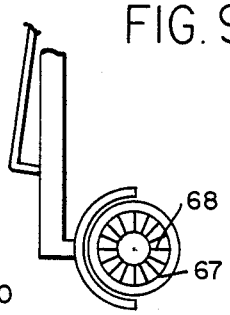
FIG. 10a
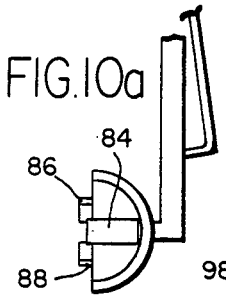
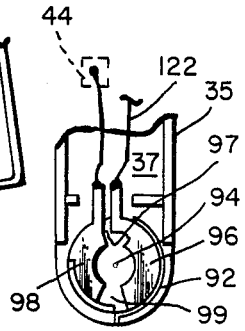
FIG. 10b
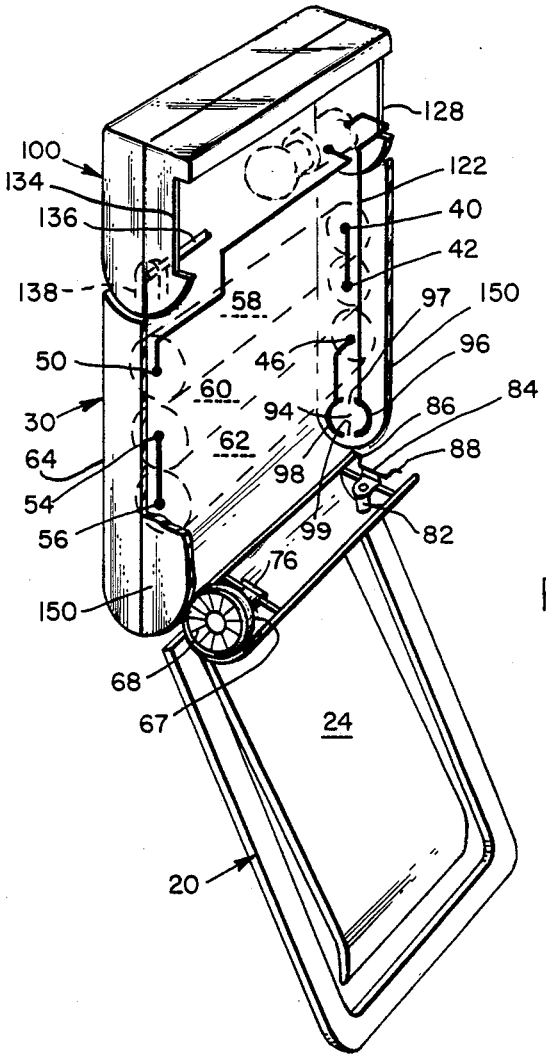
Fig. 11.

PORTABLE BOOK LIGHT

BACKGROUND OF THE INVENTION

1. Field of the Invention

The present invention relates to a portable source of light which can be removably attached to a cover of a book or other object to the illuminated. The invention relates to a source of direct light which can illuminate a small area such as the page of a book and also has the added feature of being portable to enable the user to read a book or other document while reclining in a chair, lying in bed, riding in a vehicle or airplane, or other application where the source of light must be easily portable and where a source of electricity to plug the light in is not readily available.

2. Description of the Prior Art

In general, portable sources of light are well known in the prior art. A small desk lamp or pin-light desk lamp are commonly used to provide a source of direct light to illuminate a page of a document to facilitate easy reading. These sources all contain the disadvantage of requiring a surface, such as the top of a desk, on which to rest. In addition, most such sources of light require a source of electricity in order to operate, although battery operated models are available. One major disadvantage of such sources of light is the inability to use them when the reader is away from a flat surface on which they can rest.

An improvement on this type of light source wherein the light terminates in a clip which can be attached to the document to be read, such as the binding of book, is also known in the prior art. In this prior art embodiment, the source of light comes from a conventional small light bulb which is affixed to a socket. The assembly also includes a clip at its base which permits the source of light to be attached to the document. Many of the prior art embodiments are run by electrical sources although battery operated models are available. One major disadvantage with all of the known prior art embodiments is that the light will remain on until the user manually shuts it off, either by shutting off the on-off switch or alternatively, by removing the electric plug from the outlet. While this is not a major consideration when the source is used during the day, it becomes a significant problem when the reader is using the source of light to illuminate a book he or she is reading while in bed just prior to going to sleep. Many times, a reader will fall asleep while reading the book. Should this occur and the light source remain on, the hot light bulb resting against the user's blanket, sheet or mattress over several hours could ignite the material and cause a fire. It is therefore important that the bulb be shielded from coming in contact with anything such as the mattress, sheet or blanket, and further that the light be automatically turned off by a simple physical process which is likely to occur if the light source comes in contact with anything. These additions, which are not present in embodiments known in the prior art, would make the portable book light much safer to use in applications such as reading in bed.

At present, there is no known apparatus which provides a portable source of light wherein the light bulb is completely shielded, the source of light is portable, and the source of light can be automatically turned off by a simple manual manipulation when the source comes in contact with another surface.

SUMMARY OF THE PRESENT INVENTION

The present invention relates to a portable source of light which can be easily attached to the object to be illuminated, contains a self contained energy source, provides a shielding mechanism by which the light bulb is prevented from coming into contact with other objects, can be folded in order to be easily transported and provides a mechanism by which the source of light can be automatically turned off when the container in which the light source is housed comes in contact with another physical object.

It has been discovered, according to the present invention, that if a light source is composed of three sections which include a light source containing member rotatably mounted to a casing member housing the power source which is in turn rotatably attached to an attaching mechanism by which the apparatus is attached to a surface, and the attaching mechanism between the casing member and attaching means includes an apparatus which permits the light power circuit to be on when the apparatus is in use and turned off when the apparatus is closed, then the Portable Book Light of the present invention can be safely used during many applications including reading in bed.

It has also been discovered, according to the present invention, that if the light bulb is shielded within a casing and protected by an outer transparent shield or lens, then the present invention can be safely used since the danger of a lighted bulb coming in contact with any surface is eliminated.

It is therefore an object of the present invention to provide of portable source of light which can be easily attached to a surface such as the rear cover of a book and which further can easily and safely be used as a light source for any multiplicity of applications where portability and safety are required.

It is another object of the present invention to provide an apparatus wherein the light will be automatically turned off when the object is closed, in order to eliminate any fire hazard and further to save the batteries from unnecessary wear and tear when the apparatus is not in use.

It is a further object of the present invention to provide an apparatus where the light bulb is safely shielded from coming in contact with other objects.

It is an additional object of the present invention to provide a portable source of light for use in reading a book.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 1 is a perspective view of the present invention Portable Book Light used in conjunction with a book.

FIG. 2 is a side elevational view of the present invention Portable Book Light in the open position and attached to the rear cover of a book.

FIG. 3 is a side elevational view of the present invention in the closed position.

FIG. 4 is a front elevational view of a portion of the present invention with the light containing member shown in partial cross-section and the casing member containing the power source shown in cross section.

FIG. 5 is an enlarged cross-sectional view of the light bulb contained within its pivotally supported socket.

FIG. 6 is a cross-sectional view taken along line 6—6 of FIG. 4.

FIG. 7 is a front plan view of the light containing section of the present invention with the protective shield or lens removed and the light bulb socket rotated ninety degrees from its normal functioning position.

FIG. 8 is a front plan view of a portion of the front attaching member and the first internal casing member to which it is attached.

FIG. 9*a* is a side elevational view of the lower left portion of the casing member looking from the direction of arrow 9*a* in FIG. 4.

FIG. 9*b* is a side elevational view of a portion of the attaching means and the first internal casing member looking from the direction of arrow 9*b* in FIG. 8.

FIG. 10*a* is a side elevational view of the lower right portion of the casing member looking from the direction of arrow 10*a* in FIG. 4.

FIG. 10*b* is a side elevational view of the attaching means and the first internal casing member looking from the direction of arrow 10*b* in FIG. 8.

FIG. 11 is a perspective transparent view of the present invention for purposes of illustrating the circuit contained in the present invention.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many specific embodiments which can represent applications of the principles of the invention. Various changes and modifications obvious to one skilled in the art to which the invention pertains are deemed to be within the spirit, scope and contemplation of the invention as further defined in the appended claims.

The present invention Portable book Light 10 is shown in use in its most common anticipated use in FIG. 1. The Portable Book Light 10 is clipped to the back cover 202 of book 200 and serves to illuminate the pages 204 through a close direct source of light.

The Portable Book Light 10 is shown in operation in FIG. 2. The Portable Book Light 10 is comprised of three primary sections, the attachment means 20, the casing member 30 and the light source containing and shielding member 100. The attachment means 20 is a clip which is further comprised of a front attaching member 22 and a rear attaching member 24. The rear attaching member 24 is attached to the front attaching member 22 by means of transverse section 26. The rear attaching member 24 is set so that it presses forward toward the front attaching member 22 in the manner of a clip, to therefore form a tight grip against the surface of an object placed between the two attaching members. The attachment means 20 is shown being clipped to the rear cover 202 of a book 200.

The attaching means 20 is in turn attached to the casing member 30. In the preferred embodiment, the attaching means 20 is fixedly attached to a section of the casing member 30 at the lowermost portion of the casing member. At its opposite end, the casing member is movably attached to the light source containing and shielding member 100. As shown in FIG. 2, when the Portable Book Light is in operation, the light source is moved to shine upon the pages 204 of book 202.

The internal portion of the light source containing and shielding member 100 and upper portion of the casing member 30 is best illustrated in the cross sectional views of FIGS. 4 and 6, and in the enlarged front elevational view of the light source shield member 100 shown in FIG. 7. The light source shield member 100 comprises a recessed chamber 102 with a reflective surface 104 located at the rear portion and upper and lower portion of the light source shield member 100. At one end of the chamber 102 is a light socket retaining means 106 which by way of example can be a stationary clip. The retaining means 106 in turn rotatably supports a socket member 110 by means of pivot pins 112 and 114. As best illustrated in the enlarged cross-sectional view of the light bulb assembly and retaining means in FIG. 5, a first conducting means or wire 122 is attached to the rear end 116 of the socket member 110 and a second conducting member or wire 124 is attached to the side wall 118 of socket member 110. The attachments can be made by conventional means such as soldering. A light bulb 120 can be screwed into socket member 110 in conventional fashion. When it is necessary to remove the light bulb 120, the socket member 110 can be rotated about pivot pins 112 and 114 by approximately ninety degrees as shown in FIG. 7 so that the light bulb 120 can be unscrewed from the socket member 110. A transparent shield or lens 126 is then inserted onto the front of the light source shield 100 so that the light bulb 120 and its attaching means 106 are enclosed within recessed chamber 102. The transparent shield 126 can be retained therein by conventional means such as being slidably retained by the walls of light source shield 100 or alternatively as shown in FIG. 2 and 11 by being retained by clip members 130 and 134 located at the transverse edges 128 and 132 of the transparent shield 126. In one alternative embodiment, the area of the shield 126 adjacent the socket 110 can be translucent, to thereby conceal the light bulb retaining apparatus previously disclosed. In an alternative embodiment (not shown), the pivot pins 112 and 114 can be eliminated and the socket member 110 held in the retaining means 106 by tension.

The light source shield member 100 is rotatably mounted to the casing member 30 on a rod 136 supported by a pair of hinges 138 and 140, shown in phantom in FIG. 11. The hinges 138 and 140 permit the light source shield member 100 to rotate relative to the casing member 30 by approximately 20 degrees in the forward or reverse direction. This will permit the user to adjust the direction of the light by any multiplicity of different angles to accommodate the desires of the individual users.

The internal portion of the casing body 30 is best illustrated in FIG. 4 and in the transparent perspective view of FIG. 11. The casing 30 comprises a chamber 32 which is designed to house a multiplicity of energy sources such as several batteries 58, 60 and 62. While only three such batteries are shown, it will be appreciated that any multiplicity of such batteries are within the spirit and scope of the present invention. The internal side walls 34 and 36 of chamber 32 support a number of positive and negative terminals of a conventional design. As shown in FIGS. 4 and 11, internal side wall 36 supports metal member 38 which contains positive terminal 40 and negative terminal 42. Separately attached below this is metal member 44 which contains positive terminal 46. Similarly, internal side wall 34 supports metal member 48 which contains negative terminal 50. Separately attached below this is metal member 52 which contains positive terminal 54 and negative terminal 56. Positive terminal 40 is aligned with negative terminal 50. Positive terminal 54 is aligned with negative terminal 42. Positive terminal 46 is aligned with negative terminal 56. In FIG. 4, the positive terminals are shown at 38 and the negative terminals are shown at 40. The energy sources 58, 60 and 62 are appropriately configured and set in the chamber 32 to correspond to the negative and positive terminals, in a conventional manner.

The lower portion of casing 30 comprises the mechanism by which the casing 30 may be rotated relative to the attachment member 20. The rotation mechanism is best illustrated in FIG. 8 and in the partial side elevational view of FIGS. 9*a* and 9*b*. Referring first to FIG. 8, the front attaching member 22 is fixedly attached to a one half of the internal lower chamber wall of casing 30. As shown in FIG. 8, the lower attached half of internal casing half 64 is affixed to the front attaching member 22 at approximately the central portion of the outer wall 66 of first internal casing half 64. The first internal casing half 64 comprises a toothed gear 68 adjacent one end. The toothed gear 68 is supported on a shaft 70 which in turn is supported on a first internal wall 72. The first internal wall comprises a slotted opening 74 through which the shaft 70 is inserted and held therein by being sandwiched between shaft stop 76 at its far end and an internal spring 78 sandwiched between the first internal wall 72 and the rear surface of the toothed gear 68. The spring 78 also serves to urge the toothed gear 68 in an outward direction and to engage a mating surface in the casing 30. The opposite end of the first internal casing half 64 also comprises a second internal wall 80 and a dowel 82 adjacent the second internal wall 80. A two pronged metal connector clip 84 containing a first connector prong 86 and a second connector prong 88 is supported by the dowel 82 and the second internal wall 80.

The lower portion of casing 30 contained lower side walls 31 and 35 into which the first internal casing half 64 is rotatably inserted. These walls are shown in FIGS. 4, 9*a* and 10*b*. In order to insert the first internal casing half 64 as shown in FIG. 8, the apparatus as shown in FIG. 8 would be inserted such that edge 67 of first internal casing half 64 adjacent the toothed gear 68 would be adjacent wall 31 of casing 30. The internal wall 33 of side wall 31 contains a mating gear set 90 which comes in contact with toothed gear 68. The toothed gear 68 intermeshes with the mating gear 90 such that the first internal casing half 64 can be rotated within casing 30 at a multiplicity of angles as the toothed gear 68 is rotated relative to the internal wall mating gear set 90 and will be held in this multiplicity of different angles as the gears interlock at each respective rotational location. The lower side wall 35 of casing 30 contains a ledge 92 on its internal side wall 37. The ledge 92 in internal side wall 37 comprises a nonconducting mounting member 94 which supports a pair of conducting plates. As shown in the front perspective view in FIG. 10*b*, the conducting plates 96 and 98 are in the shape of a pair of partial arcs which are separated by gaps 97 and 99 respectively. One conducting wire from the light bulb socket is attached to one of the conducting plate portions and the lowermost metal plate 44 is attached to the other conducting plate portion. As shown in the transparent illustration in FIG. 11, second wire 124 is attached to metal plate 48 and negative terminal 50, first wire 122 is attached directly to first conducting plate 96, and metal plate 44 is attached to second conducting plate 98.

When the first internal casing half 64 is inserted into the lower portion of casing 30 as described, second edge 69 of first internal casing half 64 is adjacent the internal side wall 37 of casing 30 and the metal prongs 86 and 88 of metal clip 84 abut respective conducting plates 96 and 98. Gaps 97 and 99 are spaced approximately 180 degrees apart, and therefore, depending on the relative alignment of the first internal casing half 64 with the lower portion of casing 30 and side walls 31 and 35, the prongs 86 and 88 can either abut a respective gap 97 and 99 or alternatively can abut conducting plates 96 and 98. As shown in the transparent view of FIG. 11, when the metal prongs 86 and 88 abut portions of conducting plates 96 and 98, the circuit is closed and the energy sources or batteries 58, 60 and 62 cause the light bulb 120 to be lit. When the metal prongs 86 and 88 abut respective gaps 97 and 99, the circuit is broken and the light goes out. Therefore, the width of gaps 97 and 99 will determine how much of an arc of rotation can be set by the first internal casing half 64 and the attached attaching means 20 relative to the casing 30 during which the circuit will be opened and the light bulb 120 will not be lit. In the preferred embodiment, the gaps 97 and 99 are set so that the circuit is open when the attaching means is rotated one hundred and eighty degrees relative to and abuts the casing member 30 so that the Portable Book Light 10 is in the closed position as shown in FIG. 3 and will further remain closed during approximately a ten degree arc. Thereafter, the metal prongs 86 and 88 abut the conducting plates 96 and 98 and the circuit is closed to thereby enable the batteries to cause the light bulb 124 to be lit. It will be appreciated that the wires can run down the opposite side of casing, the metal plates can be configured differently, and the metal clip and toothed gear can be on opposite sides from the view shown in FIG. 8. Minor rearrangement of the parts are all within the spirit and scope of the present invention.

When finally assembled, a second internal casing member 150 is attached to the first internal casing member 64 by conventional attaching means such as a mating clip (not shown), best shown in the transparent view of FIG. 11, to thereby close the internal casing member.

Therefore, through the use of the present invention, the user can easily attach the Portable Book Light 10 to any surface such as the rear cover of a book in order to provide a direct source of portable light to shine of the pages or document being read. In addition, the light bulb 124 is shielded from coming into contact with any surface since the light bulb is recessing within chamber 102 of light source shield 100 and further is protected through shield 126. Finally, if the user should fall asleep while using the Portable Book Light 10 attached to a book while reading in a chair or in bed, as the book comes to rest against the surface of the chair, blanket, sheet or mattress, the pressure against the casing will cause it to rotate about the toothed gear 68 and intermeshing gear member 90 until the casing member 30 abuts or almost abuts the front attaching means 22 to thereby cause the metal prongs 86 and 88 to abut gaps 97 and 99 to thereby open the electric circuit and extinguish the light. As a result, due to the protection of the bulb 120 from coming in contact with a surface and the ability to shut off the light, the likelihood of an accidental fire is substantially reduced. In addition, the ease of turning off the light is a substantial convenience in facilitating easy use of the light and saving the batteries. The use of the self contained battery pack further adds to the portability of the Portable Book Light 10 and enables the user to use it in any multiplicity of locations such as when riding in a vehicle or plane as well as when reclining in a chair or in bed. While the batteries 58. 60 and 62 have been described as being conventional, it is within the spirit and scope of the present invention to make then rechargeable.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been describe din considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A Portable Light Source comprising:

a. a central casing member;

b. a light source containing and shielding member rotatably mounted to one end of said central casing member;

c. an attachment means rotatably attached to the opposite end of said central casing member;

d. said central casing member comprising an internal chamber bounded by a pair of side walls and a lower attachment means receiving section bounded by a pair of side walls;

e. said side walls of the internal chamber of said central casing member supporting a multiplicity of oppositely disposed positive and negative terminal plates;

f. a multiplicity of batteries wherein each battery is disposed between a respective pair of positive and negative terminal plates g. said light source containing and shielding member comprising an internal chamber and a removable transparent shield protecting the internal chamber;

h. the internal chamber of said light source containing and shielding member further comprising a light source retaining fixture and a light source retaining member retained thereby;

i. a light source retained within said light source retaining member;

j. said attachment means comprising a pair of attaching members;

k. at least of one the attaching members of said attachment means attached to a first internal casing half;

l. said first internal casing half designed to fit into and abut the internal side walls of the attachment means receiving section of said central casing member;

m. a first internal side wall of the attachment means receiving section of said central casing member containing a mating gear;

n. the second oppositely disposed internal side wall of the attachment means receiving section of said central casing member containing a pair of conducting plates which are separated by a pair of oppositely disposed gaps;

o. one end of said first internal casing half comprising a toothed gear which abuts said mating gear on the first internal side wall of the attachment means receiving section of the central casing member when said first internal casing half is placed inside said attachment means receiving section;

p. the opposite end of said first internal casing half containing a two pronged metal clip which abuts said pair of conducting plates when when said first internal casing half is placed inside said attachment means receiving section of the central casing member such that a respective one of the metal prongs comes in contact with a respective one of said conducting plates or a respective one of said gaps separating the conducting plates, depending upon the degree of rotation of the toothed gear relative to its mating gear;

q. a first conducting means running from a portion of said light bulb retaining member to a first one of said conducting plates located on the internal side wall of said attachment means receiving section of the central casing member;

r. a second conducting means running from a portion of said light bulb retaining member to an uppermost metal plate containing a positive or negative terminal;

s. a connecting means connecting the lowermost metal plate containing a positive or negative terminal to the second conducting plate located on the internal side wall of said attachment means receiving section of the central casing member; and t. a mating second internal casing half to close the first internal casing half;

u. whereby the light source circuit is closed when a respective one of said pair of metal prongs touches a respective one of said pair of conducting plates located at the lower side wall of said attachment means receiving section of the central casing member to thereby permit current to flow though said multiplciity of batteries and light said lighting source and the light source circuit is opened when a respective one of said pair of said metal prongs touches a respective gap separating the two conducting plates.

2. The invention as defined in claim 1 wherein said first conducting means and said second conducting means are wires.

3. The invention as defined in claim 1 wherein said light source is a light bulb.

4. The invention as defined in claim 1 wherein the gaps between the lower pair of conducting plates on the internal side wall of the attachment means receiving section are set so that the light source circuit is open when the attachment means is rotated to abut the central casing member and the light source circuit is closed when the attachment means is rotated away from the central casing member.

5. The invention as defined in claim 1 wherein said batteries are rechargable.

6. The invention as defined in claim 1 wherein spring means urges said toothed gear into contact with said mating gear.

7. The invention as defined in claim 1 wherein said light source retaining means is a light bulb socket.

8. The invention as defined in claim 1 wherein the internal chamber of said light source containing and shielding members further comprises a reflective surface.

9. The invention as defined in claim 1 wherein said light source retaining member is retained within said light source retaining fixture by means of pivot pins so that said light source retaining member can be rotated by approximately ninety degrees relative to the light source retaining fixture in order to remove the light source.

* * * * *